US007648123B2

(12) United States Patent
Gagnon

(10) Patent No.: US 7,648,123 B2
(45) Date of Patent: Jan. 19, 2010

(54) COLLAPSIBLE PUMP JACK

(76) Inventor: Peter E Gagnon, P.O. Box 875568, Wasilla, AK (US) 99687-5568

( * ) Notice: Subject to any disclaimer, the term of this patent is extended or adjusted under 35 U.S.C. 154(b) by 9 days.

(21) Appl. No.: 12/213,863

(22) Filed: Jun. 25, 2008

(65) Prior Publication Data

US 2008/0315166 A1 Dec. 25, 2008

Related U.S. Application Data

(60) Provisional application No. 60/929,378, filed on Jun. 25, 2007.

(51) Int. Cl.
*B25B 25/00* (2006.01)

(52) U.S. Cl. ..... 254/263; 254/131; 254/133 R

(58) Field of Classification Search ..... 254/221, 254/237, 243, 263, 45, 47, 133, 131
See application file for complete search history.

(56) References Cited

U.S. PATENT DOCUMENTS

| | | | | | |
|---|---|---|---|---|---|
| 336,189 | A | * | 2/1886 | White | 212/232 |
| 502,397 | A | * | 8/1893 | Emons | 254/114 |
| 3,233,746 | A | | 2/1966 | Fawell | |
| 3,580,543 | A | * | 5/1971 | Hafeli | 254/100 |
| 3,785,541 | A | | 1/1974 | Sibley | |
| 3,964,729 | A | * | 6/1976 | Harlow | 254/131 |
| 3,991,978 | A | | 11/1976 | Jones | |
| 4,643,396 | A | * | 2/1987 | Beals | 254/116 |
| 4,771,988 | A | * | 9/1988 | Scroggins, Sr. | 254/336 |
| 4,784,369 | A | * | 11/1988 | Bock | 254/45 |
| 4,938,403 | A | * | 7/1990 | Cortelli | 224/310 |
| 5,584,606 | A | * | 12/1996 | Hoogasian, Jr. | 405/221 |
| 5,618,030 | A | * | 4/1997 | Eggert | 254/131 |
| 5,697,597 | A | | 12/1997 | Goodbold | |
| 5,713,557 | A | | 2/1998 | Kang | |
| 5,806,837 | A | | 9/1998 | Cargill et al. | |
| 5,918,861 | A | | 7/1999 | Parker | |
| 5,971,360 | A | | 10/1999 | Sinsley | |
| 6,241,296 | B1 | | 6/2001 | Crabtree et al. | |
| 6,431,524 | B1 | | 8/2002 | Weber | |
| 6,651,960 | B1 | | 11/2003 | Koester | |
| D495,588 | S | | 9/2004 | Wurdack | |
| 7,086,820 | B1 | | 8/2006 | Blake | |
| 2004/0026675 | A1 | | 2/2004 | Green et al. | |

FOREIGN PATENT DOCUMENTS

| | | |
|---|---|---|
| WO | WO8605167 | 9/1986 |

* cited by examiner

*Primary Examiner*—Emmanuel M Marcelo
(74) *Attorney, Agent, or Firm*—Richard C. Litman

(57) ABSTRACT

The collapsible pump jack includes a pole formed from a plurality of pipe segments having swaged ends that telescope into one another. An M-shaped base supports the pole in an upright position. A ratcheting chain hoist has a hook for attaching the hoist atop the pole. The chain has another hook for attachment to the vehicle being lifted out of a rut in the snow or other terrain. The base is foldable from an M-shape pole mounting position to a rectangular tube storage position to surround the pole segments for storage and transport. The collapsible pump jack provides a lightweight, compact, portable accessory for lifting an end of a snowmobile, ATV, or other off-road vehicle to extricate the vehicle when it is stuck in snow or rugged terrain.

6 Claims, 4 Drawing Sheets

COLLAPSIBLE PUMP JACK

CROSS-REFERENCE TO RELATED APPLICATION

This application claims the benefit of U.S. Provisional Patent Application Ser. No. 60/929,378, filed Jun. 25, 2007.

BACKGROUND OF THE INVENTION

1. Field of the Invention

The present invention relates to jacks, and more particularly to a collapsible pump jack for lifting snowmobiles, ATVs and the like that are stuck in snow, mud, or other terrain.

2. Description of the Related Art

A common problem with snowmobiles is that they often become entrenched in dry, lightly packed snow when the rear end of the snowmobile sinks downwardly, forming a rut in the snow pack. When this occurs, the more one tries to drive the vehicle out of the rut, the deeper it sinks into the rut. Trying to free the vehicle by pushing or picking the snowmobile up out of a rut is not easy because typical snowmobiles weigh approximately five hundred pounds or more. Further, under extreme weather conditions and in remote locations, one's life may depend on the ability to lift a snowmobile from a rut.

Similar problems may occur with an All Terrain Vehicle (ATV) or a four-wheel drive vehicle when operated off-road, either when used in the snow, or over terrain that simply lacks sufficient traction. Thus, a collapsible pump jack solving the aforementioned problems is desired.

SUMMARY OF THE INVENTION

The collapsible pump jack includes a pole formed from a plurality of longitudinally nesting pipe segments, a base for supporting the pole in an upright position, and a ratchet lever chain hoist having one hook for attachment to the top segment of the pole and another hook for attachment to a vehicle (such as a snowmobile, ATV, or other off-road vehicle) for lifting an end of the vehicle out of a rut. The bottom segment of the pole is provided with a V-shape for cooperating with a V-shaped portion of the base. A bolt is provided in the center of the V-shaped portion of the base to keep the pole from sliding off the base. The base is foldable from an M-shape pole mounting position to a rectangular tube storage position to surround the separated pole segments for storage.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
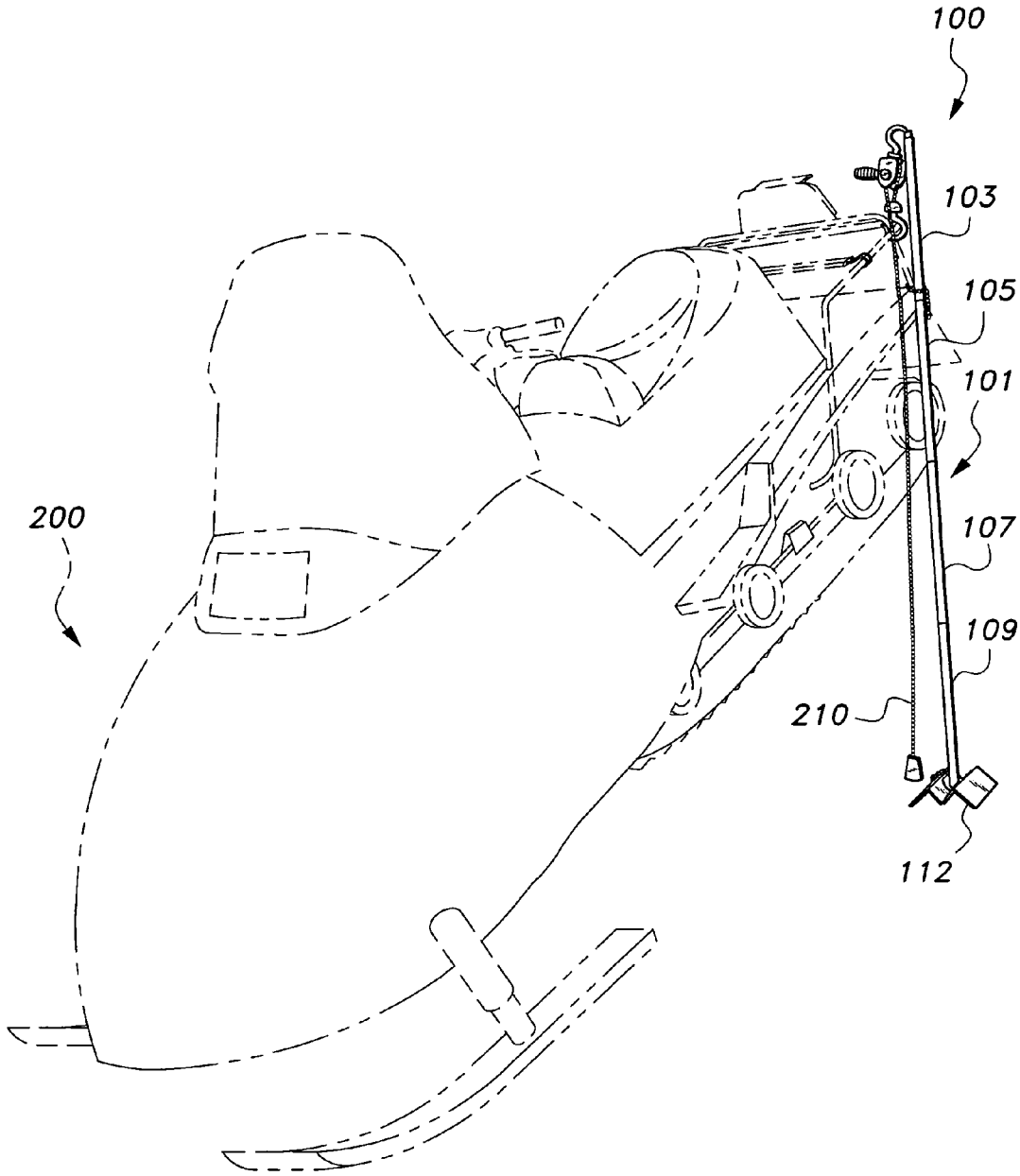
FIG. 1 is an environmental, perspective view of a collapsible pump jack according to the present invention.

The present invention is a collapsible pump jack 100 that comprises a pole 101 formed from a plurality of longitudinally nesting pipe segments 103, 105, 107, and 109. Each pipe segment 105, 107, 109 except top segment 103 has a swaged or reduced diameter end portion smaller than the inner diameter of the opposite end of each segment, so that the swaged end telescopes into the bottom of the next higher segment.

A base 112 is provided for supporting the pole 101 in an upright position. The lower segment 109 of the pole 101 has a V-shape for cooperating the base 112, and the base 112 is provided with a bolt 114 that fits into the V-shape of segment 109 to keep the pole 101 from sliding off the base 112.

Figure 3:
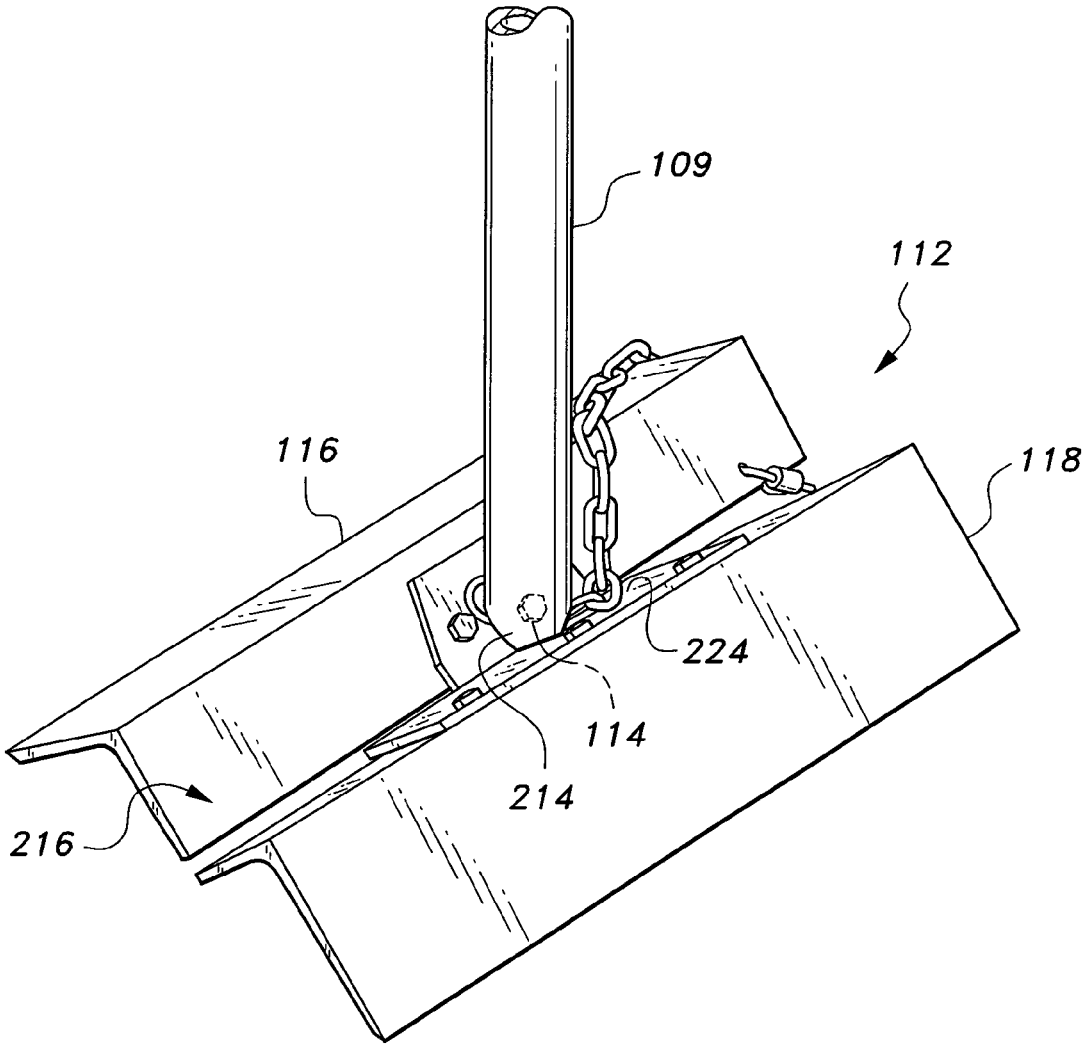
FIG. 3 is a partial perspective view of a collapsible pump jack according to the present invention, showing attachment of the pole to the base.
Figure 4:
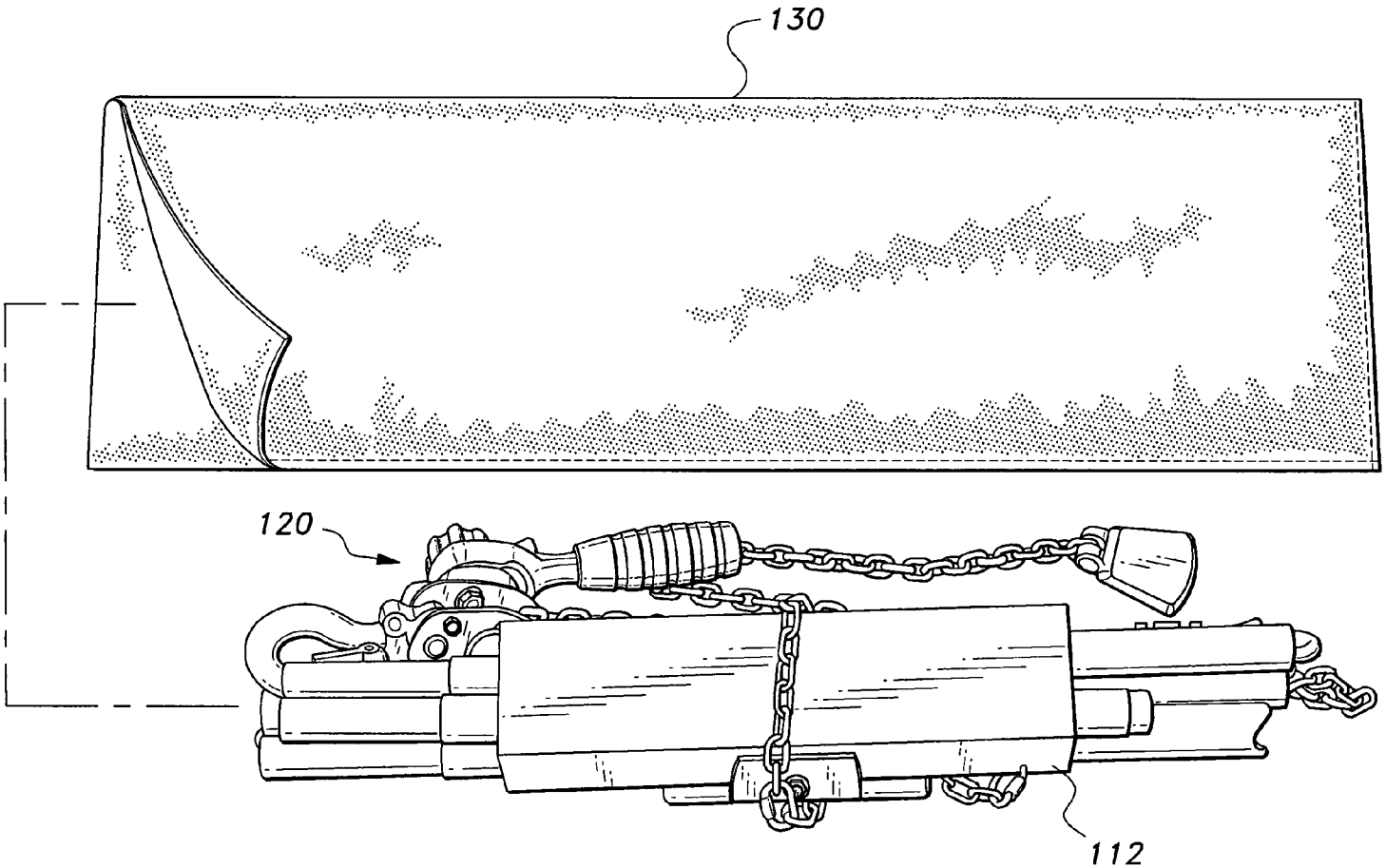
FIG. 4 is a perspective view of the collapsible pump jack according to the present invention collapsed for storage and transport.

Referring to FIGS. 3 and 4, the base 112 is provided in the form of two members 116, 118 that are generally L-shaped in cross-section and hinged together by hinge 224 to form an M-shaped pole-mounting base 112 and a rectangular shape for surrounding the disassembled pole segments 103, 105, 107, 109 in a storage position. The M-shape of the base 112 provides better traction for supporting the pole 101 in snow than a flat base, as the opposing wings bite into the snow. A guide chain 212 is wrapped around the middle of the pole 101 and secured to the snowmobile 200 or other vehicle to prevent the pole 101 from tipping over when under load. The bottom segment 109 of the pole 101 is provided with bolt 114 and a V-shape 214 for cooperating with the V-shaped portion 216 of the M-shaped base 112 in the pole mounting position to keep the pole 101 from sliding off the base 112. The pole segments 103, 105, 107, and 109 may be tethered to the base 112 by a chain, cable or the like running through the tubular pole segments.

Figure 2:
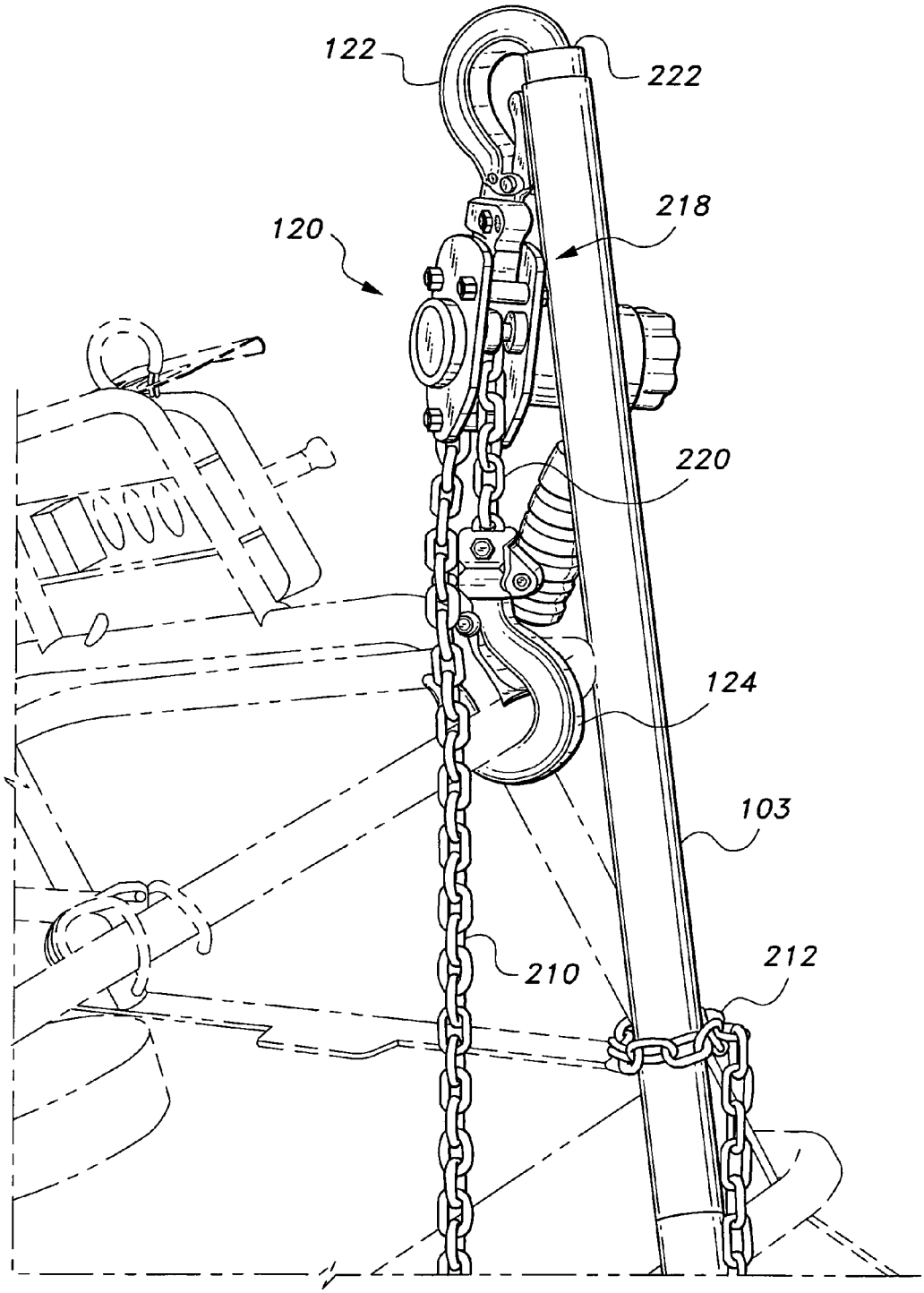
FIG. 2 is a partial perspective view of a collapsible pump jack according to the present invention, showing attachment of the chain hoist to the pole.

As shown in FIG. 2, a chain hoist 120 is provided having one hook 122 for attachment of a shell 218 housing a sheave or ratchet wheel to the top 222 of the pole 101 and another hook 124 for attachment of end 220 of chain 210 to a suitable portion of the vehicle 200 being moved. The chain hoist 120 preferably has a miniature ratchet for operation of the hoist 120 to lift the vehicle 200 up and out of the snow and a suitable load brake to prevent slippage of the chain 210. Representative specifications for the chain hoist 120 by itself may include a lifting capacity up to five hundred and fifty pounds and an overall weight of about five pounds.

FIG. 4 shows the jack 100 broken down with all the parts ready to be stored in a durable, suitably sized bag 130 that is provided for storing and transporting the pole segments 103, 105, 107, 109, the base 112 and the chain hoist 120. Each pole segment may be about eighteen inches in length. Therefore, the length of pole 101 can be varied from eighteen inches to six feet. The variable length of the pole 101 gives about ten inches to five feet, four inches of lift. The jack preferably weighs about 10-12 pounds and will lift up to five hundred fifty pounds.

It is to be understood that the present invention is not limited to the embodiment described above, but encompasses any and all embodiments within the scope of the following claims.

I claim:

1. A collapsible pump jack kit, comprising:

a pole formed from a plurality of segments having telescoping joints, the plurality of segments including a bottom segment having a substantially V-shaped end;

an M-shaped base defining a V-shaped groove, the pole being mounted on the base in an upright position with the substantially V-shaped end seated in the V-shaped groove; and a chain hoist having a shell and a hook extending from the shell, the shell hook removably mounting the chain hoist atop the pole, the chain hoist having a sheave mounted in the shell and a chain mounted on the sheave, the chain having a load hook at one end thereof adapted for attachment to a vehicle to be lifted.

2. The collapsible pump jack kit as recited in claim 1, wherein said M-shaped base comprises a pair of elongated L-shaped members and a hinge pivotally joining the pair of L-shaped members, the base being foldable from the M-shape into a rectangular tube for storage and transport of said plurality of pole segments.

3. The collapsible pump jack kit as recited in claim 1, wherein each said pole segment comprises a hollow tube.

4. The collapsible pump jack kit as recited in claim 3, wherein said plurality of pole segments includes a top segment, the shell hook releasably engaging the top segment.

5. The collapsible pump jack kit as recited in claim 1, wherein said plurality of pole segments have swaged ends.

6. The collapsible pump jack kit as recited in claim 1, further comprising a storage bag for removably receiving said pole, said M-shaped base and said chain hoist when said collapsible pump jack kit is in a disassembled state.

* * * * *